United States Patent [19]

Simon

[11] 4,311,442

[45] Jan. 19, 1982

[54] ROTARY PISTON MACHINE WITH ALTERNATING PISTONS AND SEALINGS THEREFOR

[76] Inventor: Istvan Simon, Otterngutstrasse 37, Schaffhausen CH-8200, Switzerland

[21] Appl. No.: 40,916

[22] PCT Filed: Aug. 9, 1978

[86] PCT No.: PCT/CH78/00012

§ 371 Date: May 23, 1979

§ 102(e) Date: May 21, 1979

[87] PCT Pub. No.: WO79/00157

PCT Pub. Date: Apr. 5, 1979

[30] Foreign Application Priority Data

Sep. 23, 1977 [CH] Switzerland ..... 011621/77

[51] Int. Cl.[3] ..... F01C 1/07; F01C 19/00

[52] U.S. Cl. ..... 418/37; 418/142

[58] Field of Search ..... 418/37, 142; 123/245

[56] References Cited

U.S. PATENT DOCUMENTS

| | | | |
|---|---|---|---|
| 988,319 | 4/1911 | Equist | 123/245 |
| 1,028,848 | 6/1912 | Aabel | 418/37 |
| 1,482,627 | 2/1924 | Bullington | 123/245 |
| 2,155,249 | 4/1939 | Bancroft | 418/37 |
| 2,547,374 | 4/1951 | Carideo | 418/37 |
| 3,922,118 | 11/1975 | Bancroft | 418/37 |

*Primary Examiner*—John J. Vrablik

*Attorney, Agent, or Firm*—Saul Jecies

[57] ABSTRACT

In a rotary piston machine with a cylindrical housing and a drive shaft lying in the cylinder axis, the housing encloses a hollow rotation space in which three sector-shaped rotary pistons provided with sealings and having angular velocities periodically changing relative to each other are arranged one after the other, so that working spaces develop between the rotary pistons whose volumes change periodically. For this purpose, the drive shaft carries an eccentric cam on which is posed a rotating driving plate provided with internal toothing which engages a spur wheel, the driving plate carrying driving pins each in operative connection with a piston rod and having a torsion-resistant connection to one of the rotary pistons via a hollow shaft.

18 Claims, 26 Drawing Figures

II
1
15
16
21
V
17
12
9
IV
18
19
14
13
10
20
8
7
6
1a
III
11
2
3
3a
5
4a
4

1
15
21
16
18
12
6
9
19
17
10
13
14
11
7
1a
20
2
5
3
4

23
31
32
15
45
29
42

22
16

17
12

49

25
42
31
32
45
29
24

33,34
39
44
43
41
46

38

43,46
47

43,46
47

39
40
36
33
34
35
37

43
24
25
XIV
XIV
XII
XII
46
27

27
26
28

30

ROTARY PISTON MACHINE WITH ALTERNATING PISTONS AND SEALINGS THEREFOR

The invention concerns a rotary piston machine with a cylindrical housing and a drive shaft lying in the cylinder axis, the housing enclosing a hollow rotation space in which at least two sector-shaped rotary pistons with angular velocities changing periodically relative to each other are arranged one after the other in such a way that working spaces develop between the rotary pistons whose volumes change periodically, the drive shaft carrying an eccentric cam on which is posed a driving plate provided with internal toothing which engages a spur wheel coaxial with the drive shaft and firmly fixed to the housing, the driving plate carrying driving pins each in operative connection with a piston rod and each piston rod having a torsion-resistant connection to one of the rotary pistons via a hollow shaft lying coaxially to the drive shaft, the rotary pistons being provided with sealings.

With the known rotary piston machines, e.g. CH-PS Nos. 338'326, 369'623, U.S. Pat. Nos. 3,108,578, 3,246,835, 3,288,121, GB-PS Nos. 961,872 and 1,000,418, the working spaces are sickle-shaped and the pistons execute partially rolling motions, which makes sealing very difficult and poses all but insurmountable problems.

Therefore, the problem arose of creating a rotary piston machine with working spaces whose ratio between volume and surface is relatively favorable and which are well sealed.

The rotary piston machine according to the invention represents a solution to this problem and is characterized by the fact that each of the sealings effective outward radially on the outer casing of the rotary piston as well as on the baffle of same is equipped with a two-piece sealing rod, the two sections of which being offset on the longitudinal sides facing each other in such a way that they have a common displacement plane, and that the two rod sections are subjected to the pressure of a helical spring acting in the axial direction and a bent leaf spring acting radially.

Figure 1:
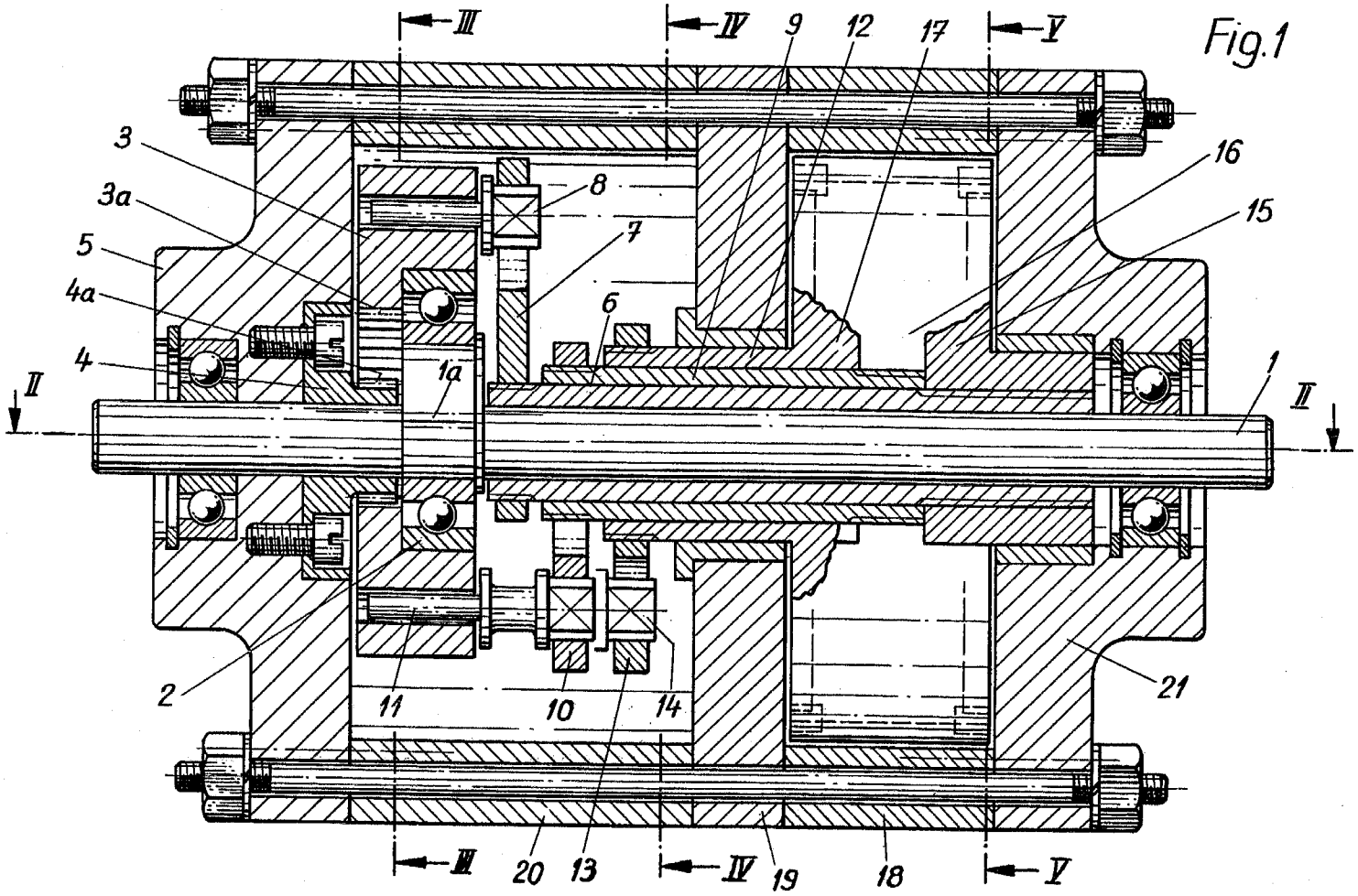
Figure 2:
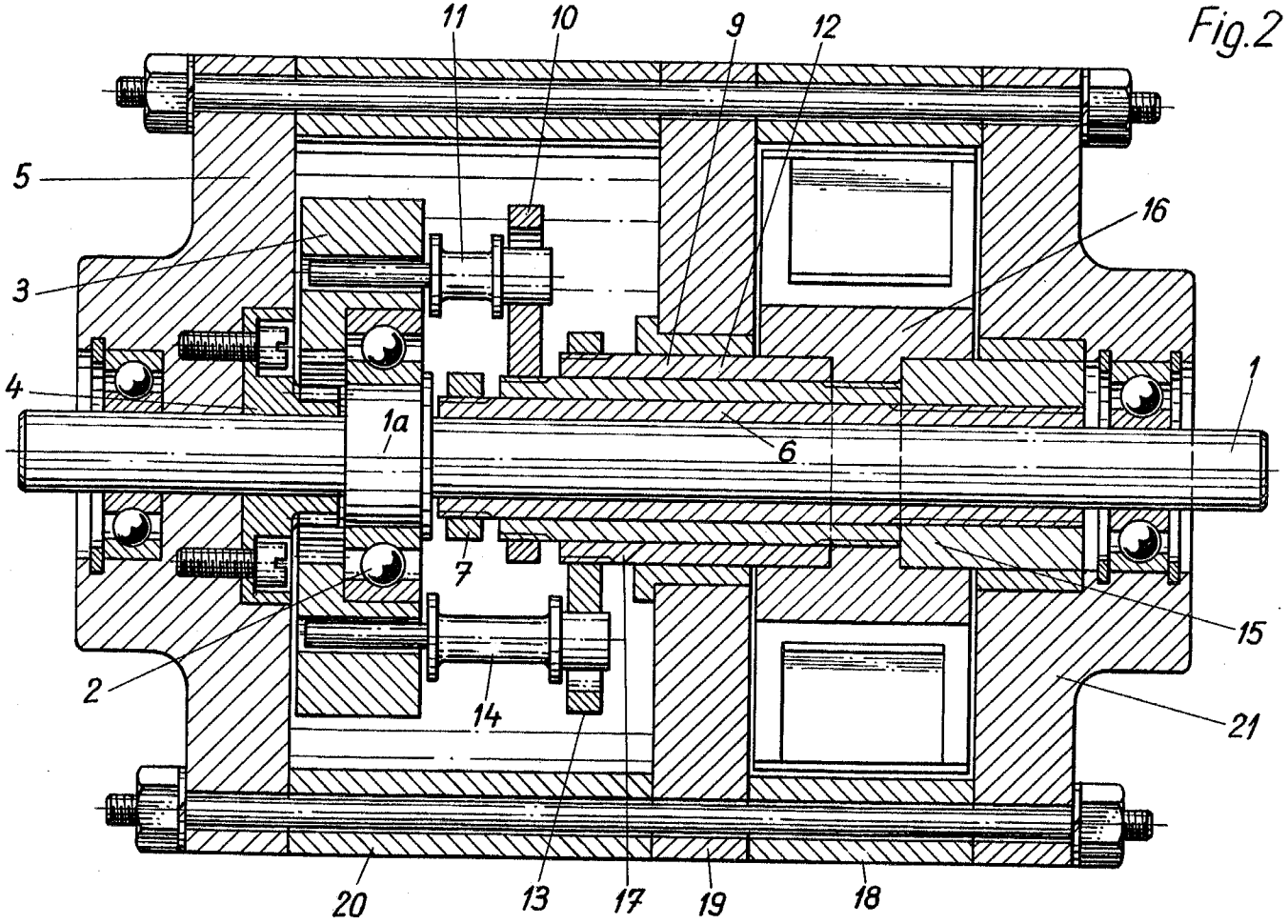
Figure 3:
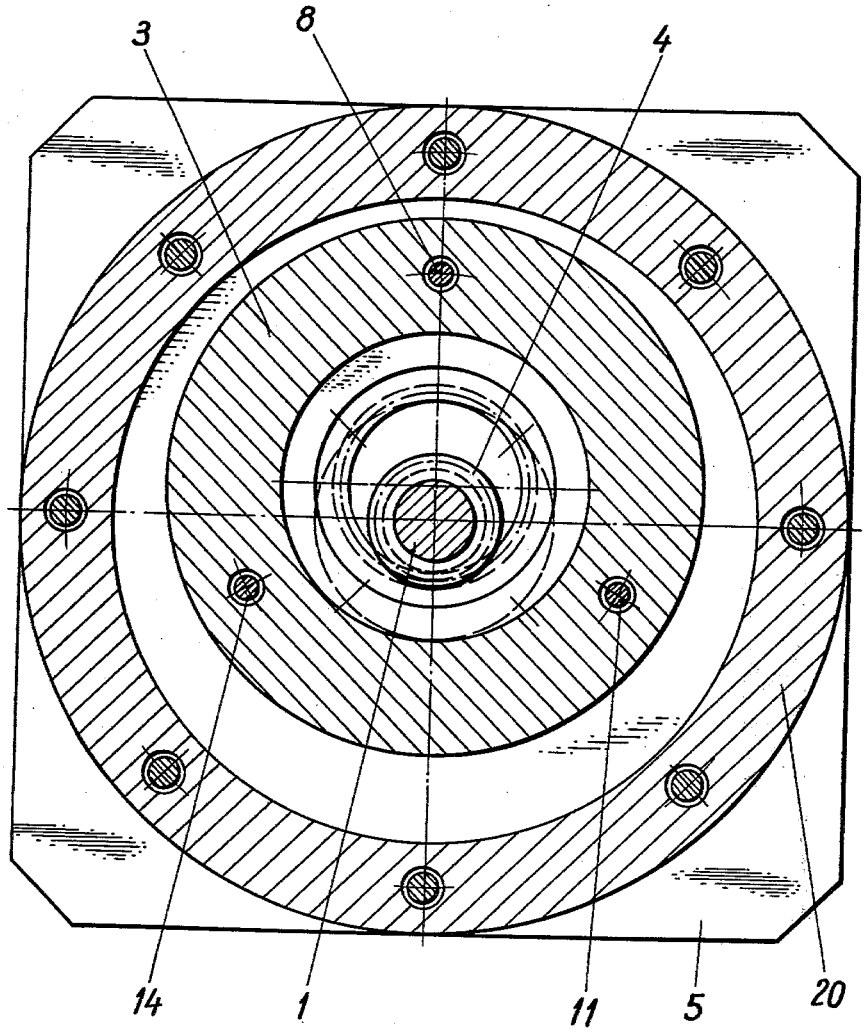
Figure 4:
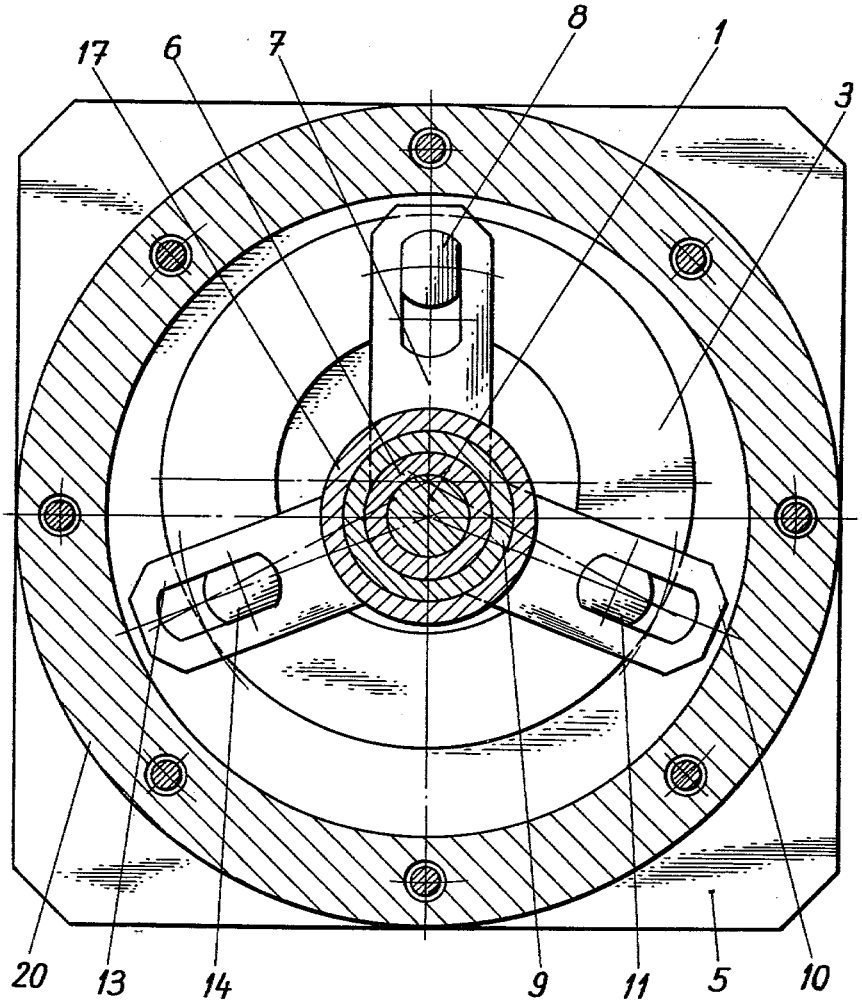
Figure 5:
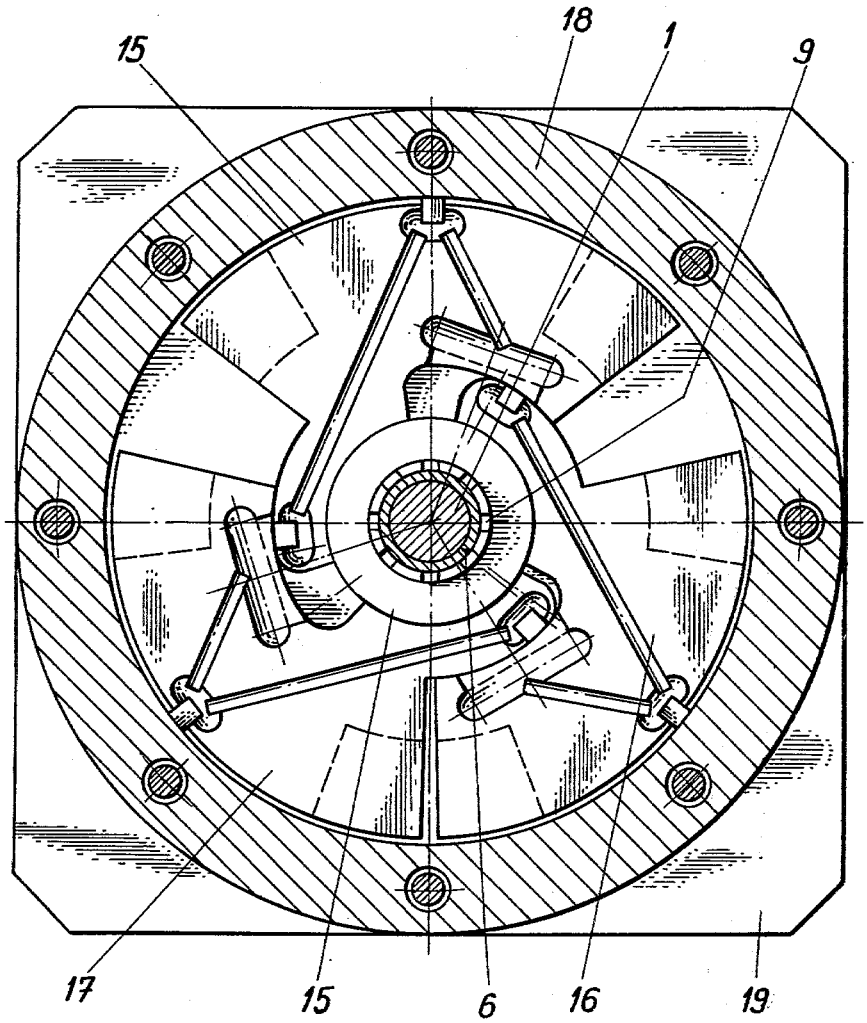
Figures 6, 7, 8, 9, 10:
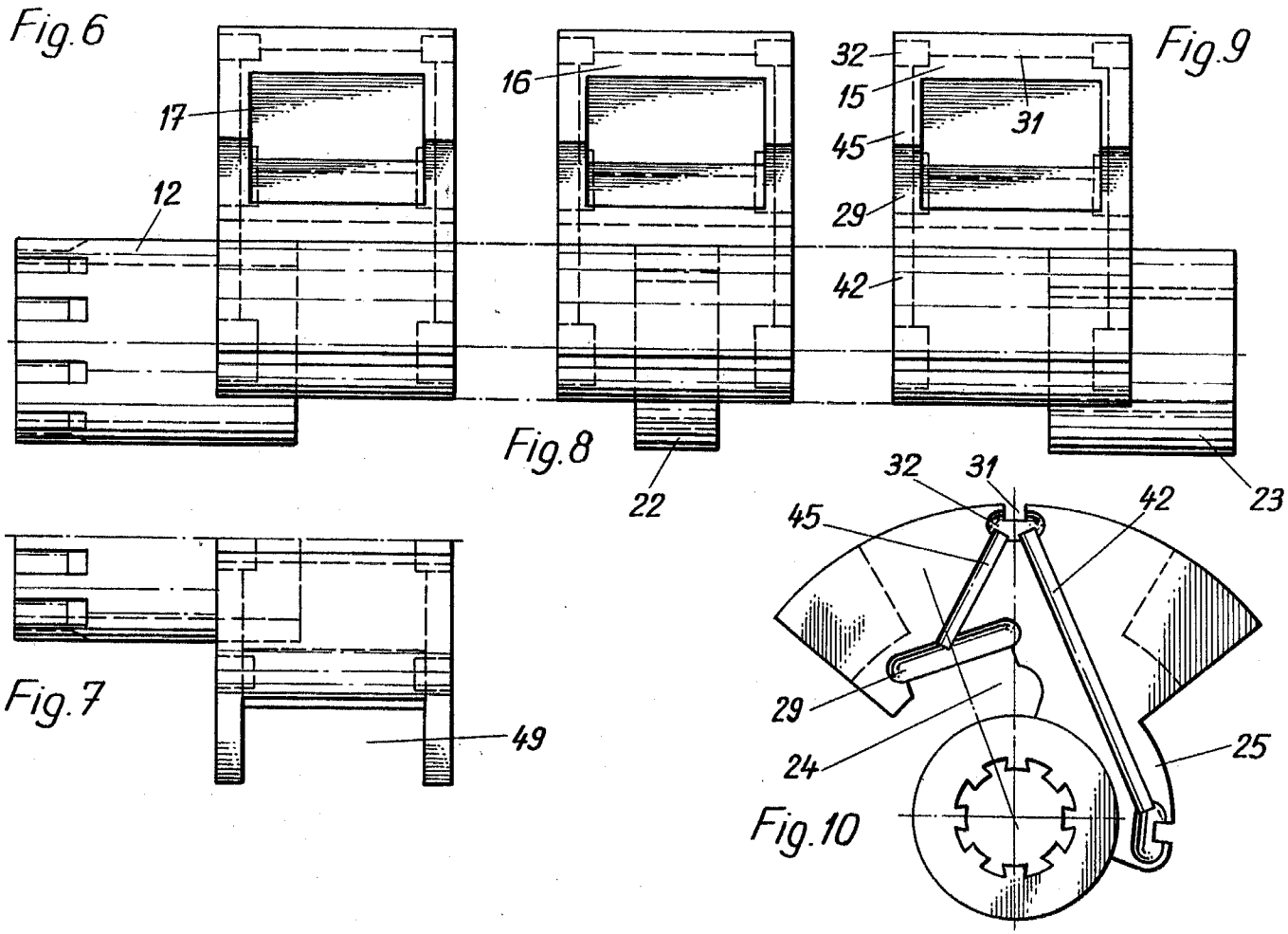
Figures 11, 12, 13, 14, 15, 16, 17, 18:
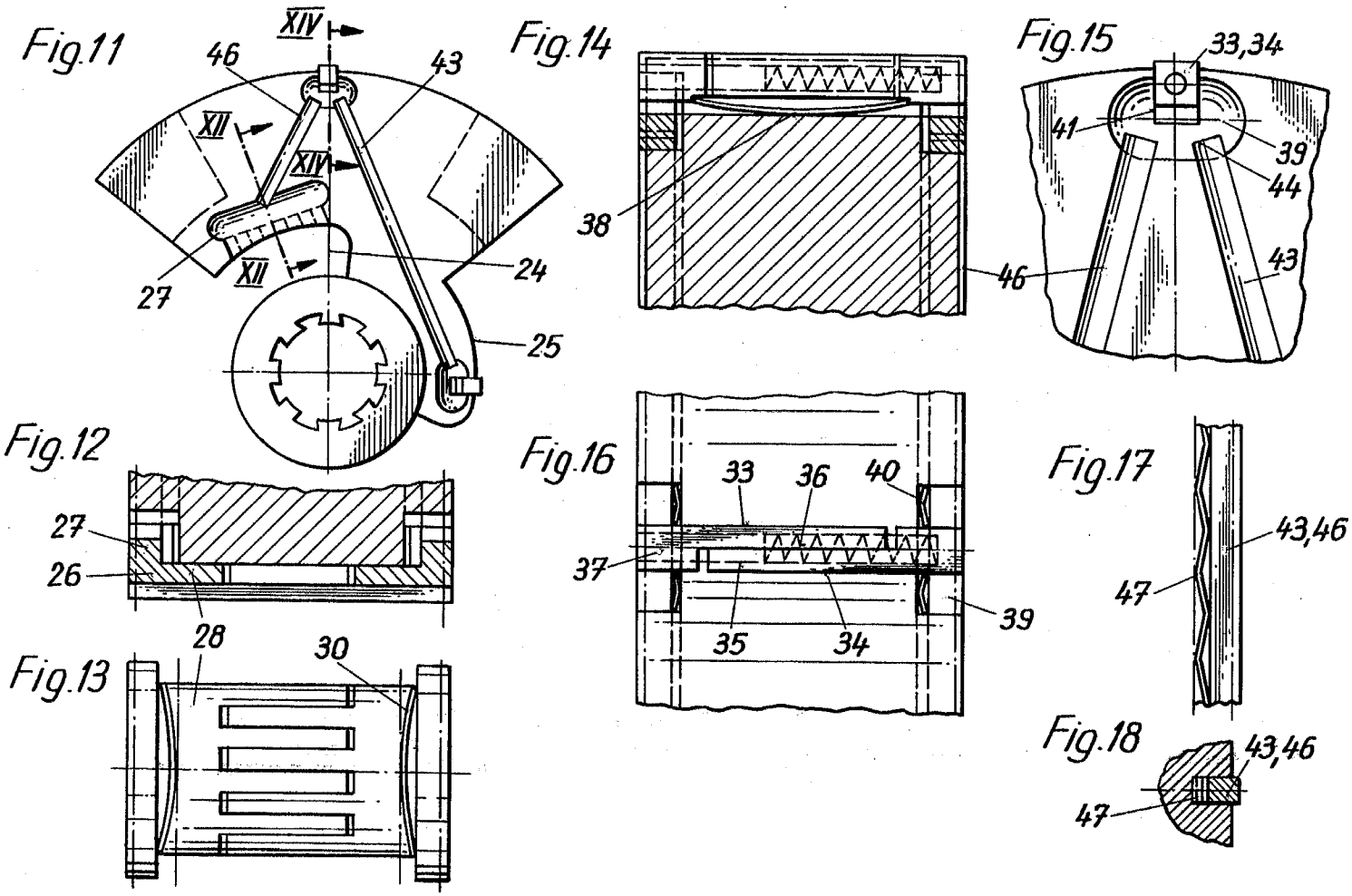

The appended drawings shown, as an example, a form of the rotary piston machine according to the invention. Shown are in:

FIG. 1, a vertical longitudinal section through the rotary piston machine,

FIG. 2, a horizontal section along the line II—II of FIG. 1 through the rotary piston machine, but with a section through the baffles of two rotary pistons, FIG. 3, a cross-section along the line III—III of FIG. 1, with a view of the top of the driving plate, FIG. 4, a cross-section along the line IV—IV of FIG. 1, with a view on the piston rods, FIG. 5, a cross-section along the line V—V of FIG. 1, with a view of the rotary pistons, FIG. 6, a view of the rotary piston with the outside hollow shaft, at right angles to the axis, FIG. 7, a horizontal projection of part of FIG. 6, FIG. 8, a view of the rotary piston for the central hollow shaft, at right angles to the axis, FIG. 9, a view of the rotary piston for the inside hollow shaft, at right angles to the axis, FIG. 10, the rotary piston of FIG. 9 with recesses for the sealing elements, as seen in the axial direction, FIG. 11, the same rotary piston with attached sealing elements as seen in the axial direction, FIG. 12, a section through the inside sealing along the line XII—XII of FIG. 11, on a larger scale, FIG. 13, a horizontal projection of part of FIG. 12, FIG. 14, a section through the outside sealing along the line XIV—XIV of FIG. 11, on a larger scale, FIG. 15, a side view of part of FIG. 14, FIG. 16, a top view of the sealing of FIG. 14, FIG. 17, a rod sealing, FIG. 18, a cross-section through same, FIGS. 19 to 22, a schematic representation of the rotary pistons' displacement relative to each other, as seen through the driving plate, and FIGS. 19*a* to 22*a*, a schematic representation of the four-stroke cycle of a rotary piston combustion engine.

The rotary piston machine represented in FIGS. 1 and 2 has an easily-built, cylindrical housing 5, 18–21, with a drive shaft 1 installed in its horizontal axis. The rotary piston machine is intended as a four-stroke machine and is designed as a combustion engine according to FIGS. 19*a* to 22*a*. The housing 5, 18–21, consisting of a cylindrical casing 18, a pressure wall 19, and an outer cylinder cover 21, encloses a cylindrical rotation space. In it are three sector-like rotary pistons 15, 16, 17 installed about the drive shaft 1 one after the other in their direction of rotation, their angular velocities relative to each other changing periodically. Due to this periodic change in angular velocities, the working spaces (FIGS. 19–22) between the rotary pistons 15, 16, 17 are enlarged and reduced corresponding to the working volumes of known reciprocating engines.

The drive shaft 1 carries an eccentric cam 1*a*, on which is slipped a radial ball bearing 2. The outer ring of the latter is seated in a recess of a driving plate 3, the flange of which is provided with internal toothing 3*a*. This engages the toothing 4*a* of a pinion 4, which is bolted to the gear-box side of the housing 5 coaxially with the drive shaft 1 (FIG. 1). Th centre of the driving plate 3 is also the centre of the eccentric cam 1*a*, as a result of which the axis of the driving plate 3 rotates about the housing axis; in so doing, the driving plate 3 turns in the direction of rotation of the drive shaft 1 (FIG. 3). Pivoted in the driving plate 3 parallel to the housing axis are three driving pins 8, 11, 14. These are distributed uniformly over the driving plate 3, forming equal radii with the centre and enclosing equal angles (120 degrees). The driving pins 8, 11, 14 have protruding heads each provided with two parallel gliding planes. Each of these heads engages a slot in a piston rod 7, 10, 13, each rod being fixed by a splined hub to one of the hollow shafts 6, 9, 12 lying coaxially to the drive shaft 1 (FIGS. 1 and 4). On the opposite end, each of these three hollow shafts 6, 9, 12 has a torsion-resistant connection to one of the three rotary pistons 15, 16, 17. These three rotary pistons 15, 16, 17 are provided with hubs of equal outside diameter (FIGS. 6, 8, 9). In the case of the rotary piston 17, the hub is built through the hollow shaft 12, which protrudes into the rotary piston 17 by a third of the width of the piston. The rotary piston 16 is designed with a splined hub 22, which lies in the middle of the piston and takes up the second third of the width of the piston. The rotary piston 15 has a splined hub 23, the projecting part of which is fixed to the cylinder cover 21 (FIG. 1) while the rest protrudes into the rotary piston 5 to one-third of the width of the piston. The hollow shafts 6, 9 have torsion-resistant connections to the splined hubs 23, 22.

To make effective sealing possible, each of the pistons 15, 16, 17 is provided with a recess 24 opposite its hub 23, 22, 12 as well as with a baffle 25 radially over the hub (FIGS. 10, 11). The recess 24 is designed to receive sealing that is effective inward radially while the baffle and the outer casing of the rotary piston are designed to receive sealing that is effective outward. The sealing effective inward (FIGS. 11, 12, 13) has two angular pieces 26 in the form of interlocking combs. The side flanges 27 of these angular pieces 26 are held in lateral recesses 29 (FIGS. 9, 10) of the rotary pistons in radial direction by positive locking and are pressed against the housing walls 19 and 21 by bent leaf springs 30. The radial inner flanges 28 are designed like combs and fit the curvature of the baffle 25 so as to allow a little play between the flanges 28 and the baffle 25, this play being sealed off by sealing effective outward radially provided on the baffle 25.

To receive the sealing attached to the outer casing of the rotary piston (FIGS. 14, 15, 16) the surface line of the rotary piston is provided with a groove 31 and, on each side of the rotary piston, with a recess 32 (FIGS. 9 and 10). The groove slidably pilots a two-piece sealing rod 33, 34 (FIG. 16). The two rod parts are offset by half, so that they have a common gliding plane lying in the radial direction and the cross-sections of the offset parts together correspond to the cross-section of the outer ends of the rods. The rod sections 33, 34 have a boring 35 in their longitudinal direction which accommodates a helical compression spring 36 kept from falling out by a pin 37. The helical spring 36 presses the two ends of the rods against the housing walls 19 and 21. In addition, the two-piece sealing rod 33, 34 is pressed against the cylindrical casing 18 by a bent leaf spring 38.

Inserted into each of the lateral recesses 32 (FIGS. 9 and 10) is a sealing 39 corresponding in form to a circular displacement surface, which is pressed against the housing walls 19 or 21 by a uniform, bent leaf spring 40. Both sealings 39 are provided with a groove 41 for receiving the two-piece sealing rod 33, 34 (FIG. 15). The sealing attached to the outer casing of the rotary piston in principle corresponds to the sealing provided on the baffle 25 (FIG. 11). These two sealings are connected to each other by two rod sealings 43 guided by grooves 42 and lying laterally against the rotary piston, the rod sealings 43 protruding into recesses 44 of sealings 39 (FIG. 15). In a similar manner, the sealing attached to the outer casing of the rotary piston is connected in two rod sealings 46 guided by grooves 45 and lying laterally against the rotary piston (FIGS. 9, 10, 11). The rod sealings 43, 46 are pressed against the housing walls 19 and 21 by zigzag, bent leaf springs 47 (FIGS. 17 and 18).

Figure 19:
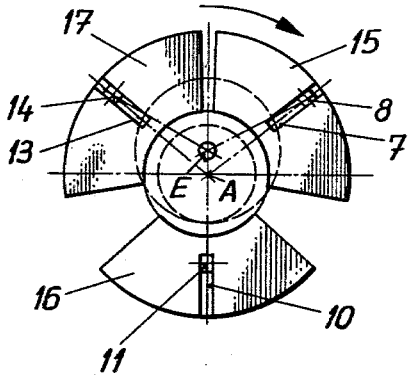
Figure 20:
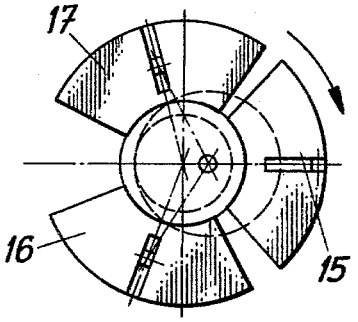

The functional movements of the rotary pistons are schematically represented in FIGS. 19–22. In FIG. 19, the eccentric axle E is on top. Hence the internal toothing 3*a* of the driving plate 3 engages the toothing 4*a* of the stationary pinion 4 at the bottom. The driving pins 8, 11, 14 are equidistant from the eccentric axle and lie at equal angles about the axle E, whereas the piston rods 7, 10, 13 are oriented radially to the housing axis A. Nevertheless, in FIGS. 19–22, as compared to FIGS. 1–4, the driving pins 8, 11, 14 are shown as having rotated by 60 degrees. In FIG. 19, the driving plate 3 forces the piston rods 7, 13 upward with its pins 8, 14, so that the rotary pistons 15 and 17 are moved relative to each other on top, which has the effect of compressing to a minimum the working space between these two rotary pistons. According to FIG. 19, this working space is at the beginning of the suction stroke. The following working space between the rotary pistons 15 and 16 is being compressed while the third working space between the rotary pistons 16 and 17 expands. According to FIG. 20, the drive shaft 1 with the eccentric E has rotated by 90 degrees in comparison to FIG. 19. The working space between the pistons 15 and 17 has enlarged and that between the pistons 15 and 16 has diminished while the working space between pistons 16 and 17 has reached its maximum volume.

Figure 21:
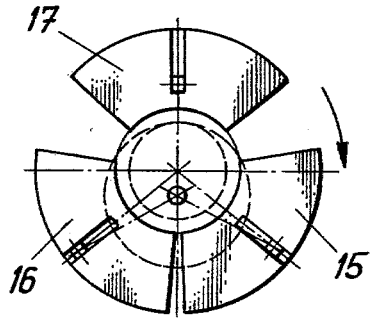

There is a two-to-three ratio between the tooth pitch of the stationary pinion 4*a* and that of toothing 3*a* of the driving plate 3. With a 90-degree rotation of the shaft 1 with the eccentric E, the driving plate 3 rolls by $\frac{2}{3}\times 90=60$ degrees along the stationary pinion 4, so that the driving plate 3 with the rotary piston and the working spaces rotates forward by ca $90-60=30$ degrees. Hence, with a 180-degree rotation of the shaft, the working spaces rotate by $180-120=60$ degrees, as shown in FIG. 21. The working space between the pistons 15 and 16 has attained its smallest volume whereas the working space between the pistons 16 and 17 has diminished again. According to FIG. 22, the working space between the pistons 17 and 15 has attained its largest volume.

With a complete revolution of the drive shaft 1, the piston position is again that of FIG. 19, with the difference that the working space between the pistons 16 and 17 reaches a minimum volume. Then each of the three working spaces has rotated by 120 degrees. With three complete revolutions of the drive shaft 1 each of the working spaces rotates by 360 degrees.

Figure 21A:
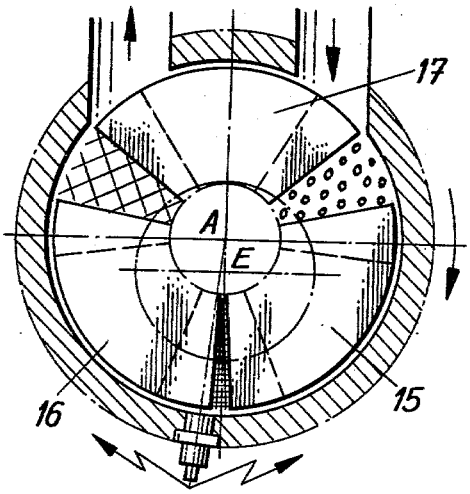
Figure 22A:
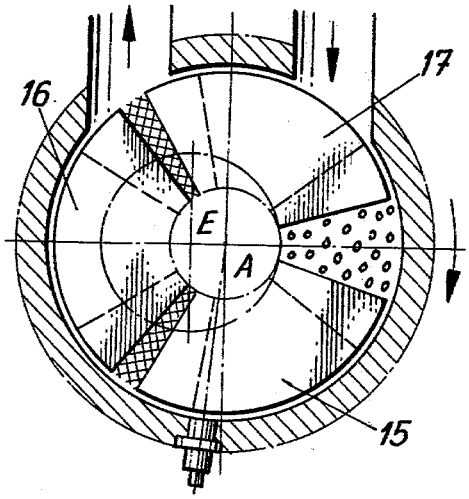

In the case of a three-piston machine designed as a four-cycle combustion engine as shown in FIGS. 19*a* to 22*a*, with three complete revolutions of the drive shaft 1, each of the three working spaces moves through all four strokes: suction, compression, expansion, exhaust. Ignition takes place after the compression stroke (FIG. 21*a*).

Figure 22:
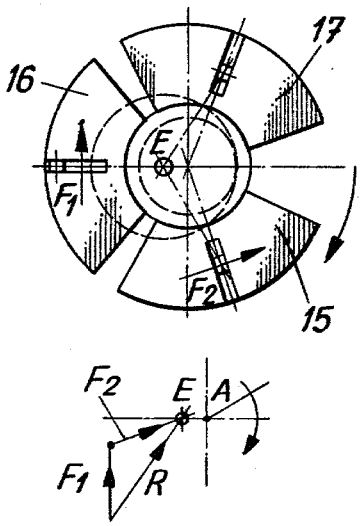
Figure 19A:
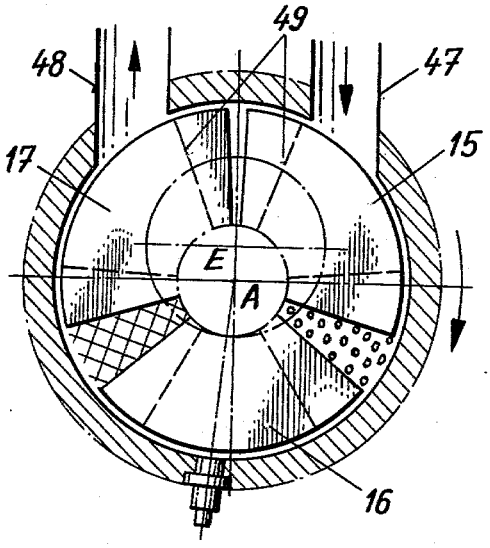
Figure 20A:
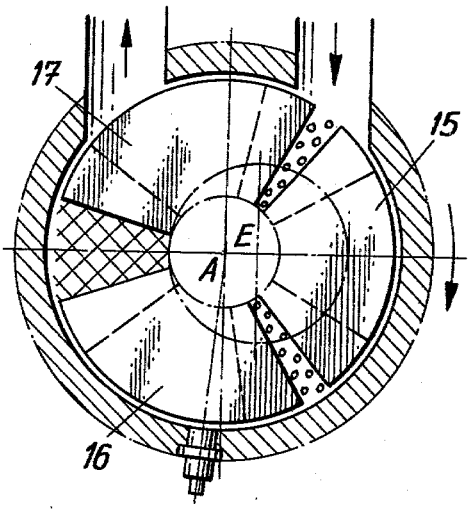

The rotation effect of the pistons 15, 16, 17 on the drive shaft 1 with the expansion stroke is seen in the force diagram beside FIG. 22. The force F1 of the rotary piston 16 together with the force F2 of the rotary piston 15 produce the resultant R on the eccentric E and a clockwise turning moment.

To avoid having to place the suction connection 47 too close to the exhaust connection 48 (FIG. 19*a*), niches 49 are provided on the rotary pistons 15, 16, 17 (FIG. 7).

Designing the four-cycle rotary piston machine as suction or force pump, compressor or steam engine results in two inlet connections and two outlet connections.

The described rotary piston machine can be designed with two, three, four, or six rotary pistons.

I claim:

1. In a rotary piston machine with a cylindrical housing and a drive shaft lying in the cylinder axis, the housing enclosing a hollow rotation space in which at least two sector-shaped rotary pistons with angular velocities changing periodically relative to each other are arranged one after the other in such a way that working spaces develop between the rotary pistons whose volumes change periodically, an improvement wherein the drive shaft carries an eccentric cam on which is posed a driving plate provided with internal toothing which engages a spur wheel coaxial with the drive shaft, said spur wheel being firmly fixed to the housing, the driving plate carrying driving pins each in operative connection with a piston rod and each piston rod having a torsion-resistant connection to one of the rotary pistons via a hollow shaft lying coaxially to the drive shaft, the rotary pistons being provided with sealings, each of the sealings effective outward radially on the outer casing of the rotary piston is equipped with a sealing rod, two sections of said sealing rod being offset on the longitudinal sides facing each other in such a way that they have a common displacement plane, and that the two rod sections are subjected to the pressure of a helical spring acting in the axial direction and a bent leaf spring acting radially.

2. A rotary piston machine according to claim 1, characterized by the fact that the piston rods have torsion-resistant connections to the rotary pistons via the hollow shafts by means of spliced hubs.

3. Rotary piston machine with a cylindrical housing and a drive shaft lying in the cylinder axis, characterized by the fact that the housing (5, 18–21) encloses a hollow rotation space in which at least two sector-like rotary pistons (15, 16, 17) whose angular velocities change periodically relative to each other are arranged one after the other so that working spaces develop between the rotary pistons whose volumes change periodically, that the drive shaft (1) carries an eccentric cam (1*a*), on which is posed a rotating driving plate (3) provided with internal toothing (3*a*), which engages a spur wheel (4) coaxial with the drive shaft (1) and firmly fixed to the housing (5, 18–21), that the driving plate (3) carries driving pins (8, 11, 14), each of which having an operative connection to a piston rod (7, 10, 13) and each piston rod (7, 10, 13) having a torsion-resistant connection to one of the rotary pistons (15, 16, 17) via a hollow shaft (6, 9, 12) lying coaxially to the drive shaft (1), and that the rotary pistons (15, 16, 17) are provided with sealings toward both radial directions as well as both axial directions.

4. Rotary piston machine according to patent claim 3, characterized by the fact that it is designed as a fourcycle machine with a two-to-three toothing ratio between the external toothing (4*a*) of the stationary pinion (4) and the internal toothing (3*a*) of the driving plate (3) rolling around the pinion (4).

5. Rotary piston machine according to patent claim 4, characterized by the fact that the driving pins (8, 11, 14) carried by the driving plate (3) make equal centre-angles of 120 degrees with the centre of the driving plate and have equal radii.

6. Rotary piston machine according to patent claim 5, characterized by the fact that the driving pins (8, 11, 14) are pivoted in the driving plate (3) and are held with their head slidable in a longitudinal slot of the piston rods (7, 10, 13).

7. Rotary piston machine according to patent claim 6, characterized by the fact that the piston rods (7, 10, 13) have a torsion-resistant connection to the rotary pistons (15, 16, 17) via the hollow shafts (6, 9, 12) by means of splined hubs.

8. Rotary piston machine according to patent claim 3, characterized by the fact that, above its hub (23, 22, 12) each of the rotary pistons (15, 16, 17) has a recess (24) for receiving the baffle (25) of the adjacent rotary piston and has its own baffle (25) on the opposite side.

9. Rotary piston machine according to patent claim 8, characterized by the fact that, on the recess (24), a sealing directed inward radially and on the baffle (25) as well as on the outer casing of each rotary piston (15, 16, 17) a sealing effective outward are provided, and that the sealing attached to the outer casing is connected to the sealing lying on the recess (24) as well as the baffle (25) by sidewise acting sealings.

10. Rotary piston machine according to patent claim 9, characterized by the fact that the inward directed sealing on the recess (24) has two sealing angular pieces (26) provided with comb-like interlocking flanges (28) lying radially inwards as well as with flanges (27) held radially in recesses (29) on both sides of the rotary pistons (15, 16, 17) and pressed outward laterally by bent leaf springs (30).

11. Rotary piston machine according to patent claim 9, characterized by the fact that each of the sealings effective outward radially on the outer casing of the rotary piston (15, 16, 17) as well as on the baffle (25) of same is provided with a two-piece sealing rod (33, 34), the two sections of which, on the longitudinal sides facing each other, are offset in such a way to give them a common displacement plane, and that the two rod sections (33, 34) are subjected to the pressure of a helical spring (36) acting outward laterally and of a bent leaf spring (38) acting radially.

12. Rotary piston machine according to patent claim 9, characterized by the fact that at each of the sealing rods (33, 34) on both sides of the rotary piston (15, 16, 17) a sealing, forced outward by a bent leaf spring (40), is provided which has a groove (41) to receive the rod sections (33, 34) as well as recesses (44) to receive lateral rod sealings (43, 46) subjected to the pressure of a zigzag-shaped leaf spring (47).

13. Rotary piston machine according to patent claim 4, characterized by the fact that it is designed as combustion engine, suction or force pump, compressor, or steam engine.

14. Rotary piston machine according to patent claim 4, characterized by the fact that it has two, three, four, or six rotary pistons.

15. A rotary piston machine with alternating pistons and seals, comprising a cylindrical housing;

a drive shaft lying on the axis of the pistons;

at least two sets of sector-shaped rotary pistons having angular velocities changing periodically relative to each other, each of said pistons being provided with an outer casing and a baffle, each set being spaced one after the other to form working spaces between the rotary pistons and the volume of said working spaces changing periodically;

an eccentric cam carried by the drive shaft;

a driving plate provided with internal gear teeth carried by said eccentric cam;

a spur wheel connected to said housing and coaxial with said drive shaft and engaged by said internal gear teeth;

driving pins carried by said driving plate and corresponding in number to the number of said rotary pistons;

a piston rod for each of said pistons;

a hollow shaft coaxial with said drive shaft and connecting each of said piston rods to a respective one of said pistons in a rotation-resistant manner;

sealing means on each outer casing of said piston rods, and further sealing means on each of said baffles, said sealing means comprising a two-piece sealing rod having longitudinal sides facing each other and offset from each other to produce a common displacement plane;

a helical spring biasing said sealing rod in an axial direction; and a bent leaf spring biassing said sealing rod in a radial direction.

16. A rotary piston machine according to claim 15, wherein each of said sets of pistons contains three sectors.

17. A rotary piston machine according to claim 15, wherein said leaf spring is bent in a zig-zag form.

18. A rotary piston machine according to claim 15, comprising spliced hubs for providing said rotation preventing connection between said piston rods and said rotary pistons via said hollow shafts.

* * * * *